United States Patent [19]

Black

[11] 4,376,406

[45] Mar. 15, 1983

[54] HYBRID GUN SYSTEM

[75] Inventor: William L. Black, China Lake, Calif.

[73] Assignee: The United States of America as represented by the Secretary of the Navy, Washington, D.C.

[21] Appl. No.: 239,288

[22] Filed: Mar. 2, 1981

[51] Int. Cl.[3] ..... F41F 1/04

[52] U.S. Cl. ..... 89/7; 89/8

[58] Field of Search ..... 89/7, 8

[56] References Cited

U.S. PATENT DOCUMENTS

| | | | |
|---|---|---|---|
| 2,129,875 | 9/1938 | Rost | 89/7 |
| 2,922,341 | 1/1960 | Treat, Jr. | 89/7 |
| 2,981,153 | 4/1961 | Wilson, Jr. et al. | 89/7 |
| 2,986,072 | 5/1961 | Hudson | 89/7 |
| 3,138,990 | 6/1964 | Jukes et al. | 89/7 |
| 3,313,208 | 4/1967 | Dorsey, Jr. et al. | 89/7 |
| 3,763,739 | 10/1973 | Tassie | 89/7 |
| 3,782,241 | 1/1974 | Ashley | 89/7 |
| 3,915,057 | 10/1975 | Broxholm et al. | 89/7 |
| 4,005,632 | 2/1977 | Holtrop | 89/7 |
| 4,050,349 | 9/1977 | Graham | 89/7 |
| 4,100,836 | 7/1978 | Hofmann | 89/8 X |
| 4,126,078 | 11/1978 | Ashley | 89/7 |
| 4,160,405 | 7/1979 | Ayler et al. | 89/7 |
| 4,336,741 | 6/1982 | Baines | 89/7 |
| 4,341,147 | 7/1982 | Mayer | 89/7 |

*Primary Examiner*—David H. Brown

*Attorney, Agent, or Firm*—R. F. Beers; W. Thom Skeer

[57] ABSTRACT

A hybrid gun system provides the benefits of both solid and liquid propellants by utilizing a shortened conventional cased ammunition which utilizes the propellant gas generated by the solid propellant contained within the cartridge case to operate a concentric fluid injection system to result in a compact firearm which offers possibilities of retrofitting conversions for certain applications.

6 Claims, 4 Drawing Figures

HYBRID GUN SYSTEM

BACKGROUND OF THE INVENTION

1. Field of the Invention

This invention pertains to the field of pyrotechnic ordnance. More particularly, the invention pertains to propellants for ballistic projectiles. By way of further characterization, the invention pertains to a gun employing both solid and liquid propellants for launching projectiles.

2. Description of the Prior Art

Solid propellant guns have been used by modern armies and navies for many years in providing armament for conduct of war. This use of fixed ammunition where the projectile, the propellant and the igniter form a unitary structure is well known. Such fixed ammunition, while satisfactory for most purposes, suffers from certain well recognized drawbacks. Among the drawbacks are the required bulk and storage space which is highly disadvantageous where ammunition is stored in limited spaces such as when used in modern naval weapons and aircraft guns. Additionally, solid propellant fixed ammunition suffers from inherent chemical limitations of the solid propellants. Such propellants tend to be fuel-rich and result in unburned propellant which causes fouling and other weapon malfunctions.

A new class of liquid propellants has showed a great promise in developmental weaponry. However, to date, difficulties associated with liquid propellants have prevented their wide applications in the military environment. Propellants having the desired efficiencies to produce projectile velocities in the normal ranges are oxygen-rich and the heat of combustion of this oxygen-rich fuel has resulted in premature failure and damage to the breech blocking mechanisms and barrels of guns employing this fuel. Although designs have been proposed which minimize this metallurgical failure by employing alloys less susceptible to reactions with the propellant, these alloys have proved expensive, difficult to work, and frequently suffer from galling and other metallurgical failures.

BRIEF DESCRIPTION OF THE INVENTION

The invention herein described overcomes these disadvantages by combining the virtues of fixed solid propellant ammunition and the liquid propellants into a hybrid system where both are employed. Since the case need not contain the entire propellant charge necessary to achieve the desired ballistic velocities of the projectile, it may be made much smaller and thereby overcome some of the storage problems associated with fixed ammunition. Additionally, the cartridge case is retained, at least in a vestigial form, and thereby provides a gas seal to protect breech mechanism parts from the caustic oxidation process produced by the burning of the liquid propellants. Further, the propellant gas produced by the solid propellant may be utilized to operate the liquid injection mechanism.

Accordingly, it is an object of the present invention to provide an improved hybrid propellant gun.

A further object of this invention is to provide a gun which initiates projectile movement with a solid propellant and injects a liquid propellant into the combustion space for the generation of additional propellant gases.

Still another object of the present invention is to provide a compact hybrid propellant gun employing a liquid injection mechanism which is concentric with the gun barrel.

These and other objects of the invention will become apparent in view of the following specification, claims and drawings in which like parts are shown with like numbers.

DESCRIPTION OF THE PREFERRED EMBODIMENT

Figure 1:
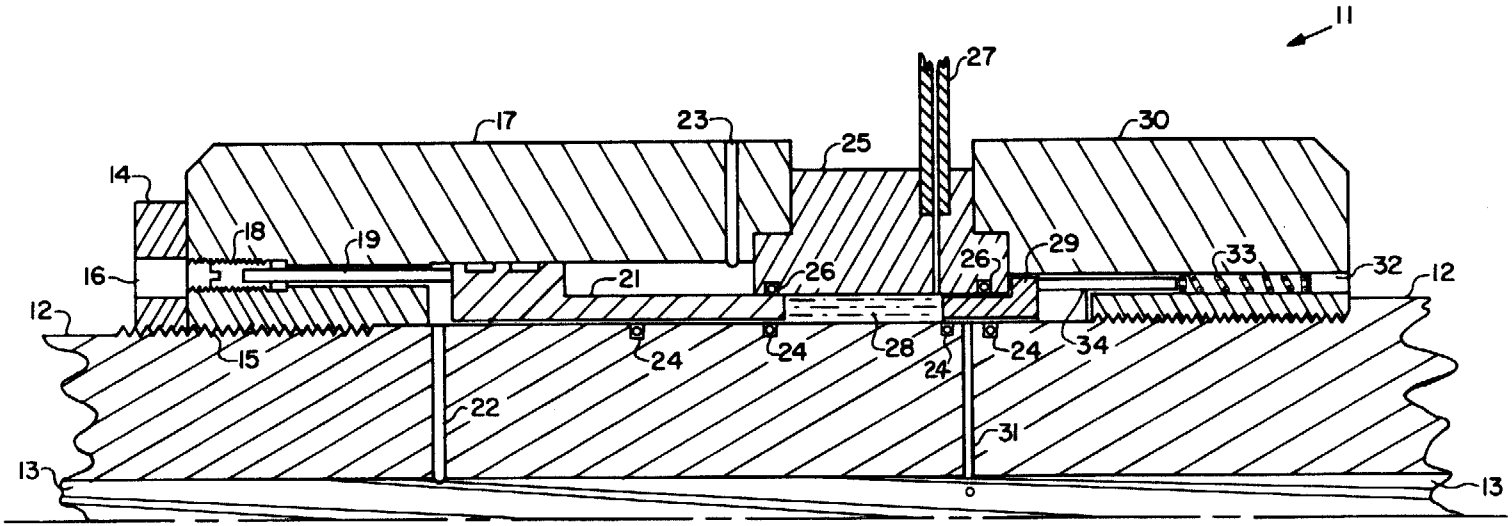
FIG. 1 is a half sectional view of the basic fluid injection system.

Referring to FIG. 1, a liquid propellant injection mechanism according to the invention is illustrated at 11 in half section. A gun barrel 12 has a rifled bore 13 extending therethrough. A threaded collar 14 is threadably received by threads 15 cut in the outer surface of barrel 12 and has alignment apertures 16, to be discussed herein, extending therethrough. Barrel 12, collar 14, and other parts of the invention may be made of ordnance steel conventional in the firearm fabrication arts.

Collar 14 secures a manifold concentric with gun barrel 12 to provide a fluid reservoir for liquid propellant 28 prior to its injection within bore 13. This manifold has a rear portion 17 which has an adjustment plug 18 threadably received therein. Plug 18 determines the rest position of pin 19 which extends into a manifold space between manifold 17 and barrel 12 to determine the initial position of a differential piston 21. The adjustment of plug 18 may be made by conventional access via apertures 16.

Piston 21 is concentric with barrel 12 and has a sliding engagement thereon which is sealed by appropriate seals indicated at 24. The aft, or chamber, end of differential piston 21 communicates with bore 13 via a suitably dimensioned gas port 22. A center section of the manifolding, indicated at 25, interfits with manifold portion 17 to be held thereby and to provide a liquid reservoir 28. Reservoir 28 is, of course, also concentric with gun barrel 12. Center section 25 has seals 26 located at the fore and aft ends thereof to provide a fluid-tight closure of liquid reservoir 28.

A fluid conduit 27 is fittingly held by center section 25 and communicates with reservoir 28 for the filling thereof with liquid propellant. A check valve 29 closes reservoir 28 and is slidingly held to gun barrel 12 by a forward portion of manifold 30. Valve 29 closes a transverse fluid conduit 31 which communicates with bore 13.

Forward manifold part 30 is threadably held on barrel 12 in a fashion not unlike that used to hold rear portion 17. However, rather than use a collar 14, barrel 12 may be shouldered to provide forward indexing of manifold 30.

Forward manifold 30 has an aperture 32 drilled therethrough and a resilient means such as a spring 33 contained therein. Spring 33 urges rod 34 into contact with check valve 29 which, in turn, causes check valve 29 to be held in the rearmost position.

The following operation of the embodiment of FIG. 1 will be described. A projectile under the influence of high temperature gases generated by a solid propellant moves down bore 13 from the left to the right in the illustrated arrangement and uncovers gas port 22. A small portion of the propellant gas is bled off through port 22 to act upon differential piston 21. Under the influence of this conventionally produced gas pressure, piston 21 is driven forward. The face of piston 21 having the smaller area forms a wall of liquid reservoir 28, pressurizes the reservoir and, in turn, forces check valve 29 to the forward position against the resilient restorative pressure provided by spring 33. The air or other gas trapped behind piston 21 between manifold section 17 and manifold section 25 escapes through a gas port 23.

The uncovering of conduit 31 by check valve 29 and the continued forward movement of piston 21 forces the liquid propellant in reservoir 28 through conduit 31 into bore 13. Because of the inertial lag of piston 21, the presence of check valve 29, and the flow rates of the propellant gas through port 22, the projectile will continue past conduit 31 prior to the uncovering thereof by valve 29 and the resultant injection of the liquid propellant.

The liquid propellant injected into bore 13 mixes with the conventionally produced propellant gases and combusts to produce additional propellant gas to accelerate the projectile to a higher velocity.

Because, as previously noted, the liquid propellant has a higher percentage of oxygen than the solid propellant, its injection further enhances the complete combustion of the solid propellant without the deleterious exposure of the metallic gun parts to the high temperature, oxygen-rich propellant gas mixture normally produced by liquid propellants.

When the projectile exits the muzzle end of bore 13, the internal gas pressure is, of course, released and the system returns to its illustrated pre-firing condition. That is, spring 33 urges check valve 29 to its rearward position, additional fluid forced through conduit 27 urges differential piston 21 to its rearward position as determined by position of rod 19. By conventional chambering techniques, not described herein, the gun is made ready for re-firing. Conventional check valves, not shown, protect the liquid propellant reservoir from excessive back pressure through fluid conduit 27.

Figure 2:
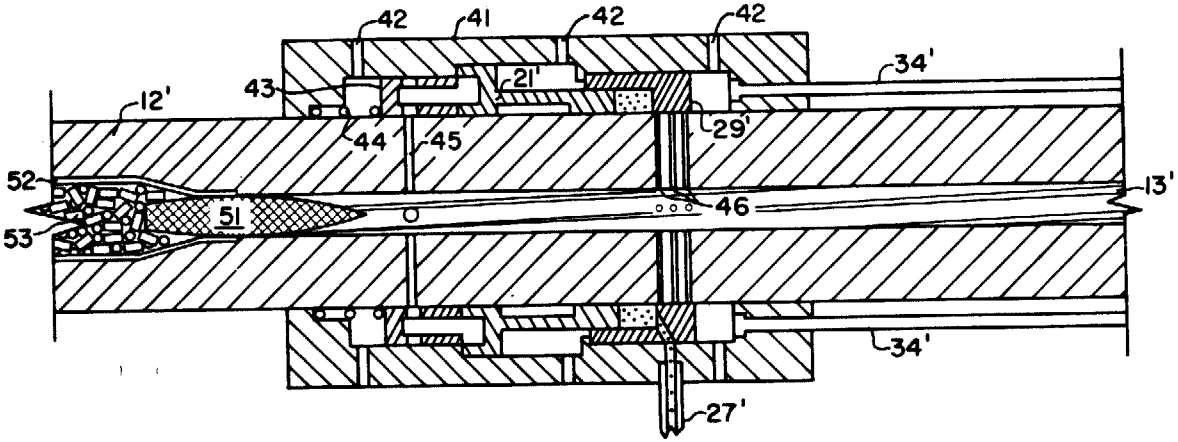
FIG. 2 is a sectional view of an improved injection system according to the invention illustrated in a before firing and before injection condition.

Referring to FIG. 2, a somewhat refined model of the invention, providing additional check valving, is illustrated. In the illustrated arrangement, a barrel 12' has a bore 13' therein and a chamber receiving a conventional cartridge case 52 which has a projectile 51 and solid propellant granules 53 contained therein. The details of the manifold 41 to permit assembly have been omitted for the sake of clarity however manifold 41 is seen to encompass essentially the same parts which perform the same purpose as the parts in the arrangement of FIG. 1.

Manifold 41 has a plurality of gas escape ports 42 extending therethrough and a liquid propellant conduit 27' carried thereby. A gas check valve 43 is slidably and concentrically carried by manifold 41 and is urged into a forward position by means of a spring 44. Gas check valve 43 communicates by an aperture drilled therethrough with gas port 45 which extends into bore 13'. Differential piston 21' abuts check valve 43 and functions in the same manner as differential piston 21 in the arrangement of FIG. 1. A liquid propellant check valve 29' has a fluid passage extending therethrough to align with fluid conduit 27' to permit liquid propellant to fill the corresponding reservoir when valve 29' is in the illustrated, rearward, position. A plurality of fluid conduits 46 connect the manifold interior with bore 13'.

A plurality of operating rods 34' are used to restore the system to operational readiness and may be analogized in their function to rod 34 and spring 33. The means urging rod 34 rearwardly has been omitted for the sake of simplicity but may include gas actuation means, if desired.

Figure 3:
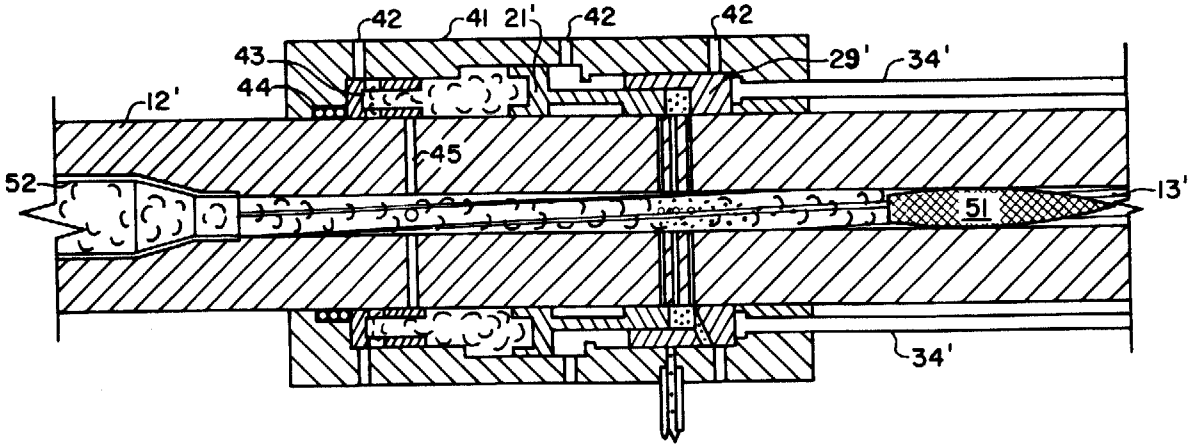
FIG. 3 shows the mechanism of FIG. 2 during firing.

Referring to FIG. 3, the operation of the embodiment of FIG. 2 may be more readily conceived. In the illustrated position, projectile 51, under the urging of solid propellant generated gas, passes gas port 45 permitting the gas to enter the manifold as an impulse. This gas impluse drives gas check valve 43 and differential piston 21' apart moving gas check 43 to a rearward position. In the rearward position, gas check 43 closes gas port 45 and prevents excessive bleed-off of propellant gases.

Differential piston 21' in driving forward, attempts to compress the liquid propellant in reservoir 28' and moves check valve 29' to its forward position uncovering conduits 46 and closing liquid propellant conduit 27' in the process. Continued movement of differential piston 21' forces the liquid propellant down conduits 46 into the combustion space in bore 13' behind projectile 51. In this arrangement, it will be noted that there are a plurality of fluid conduits 46 to transfer the liquid propellant to the combustion space. The number and size of these fluid conduits are chosen in dependence on the fluid flow at the pressures involved and the effect on barrel 12'.

The movement of operators 34 restore check valve 29' to the position illustrated in FIG. 2 and the influx of liquid propellant through conduit 27 forces differential piston 21' to its rearmost position. Gas check valve 43 is returned to its initial position by action of spring 44 in the well understood fashion.

Figure 4:
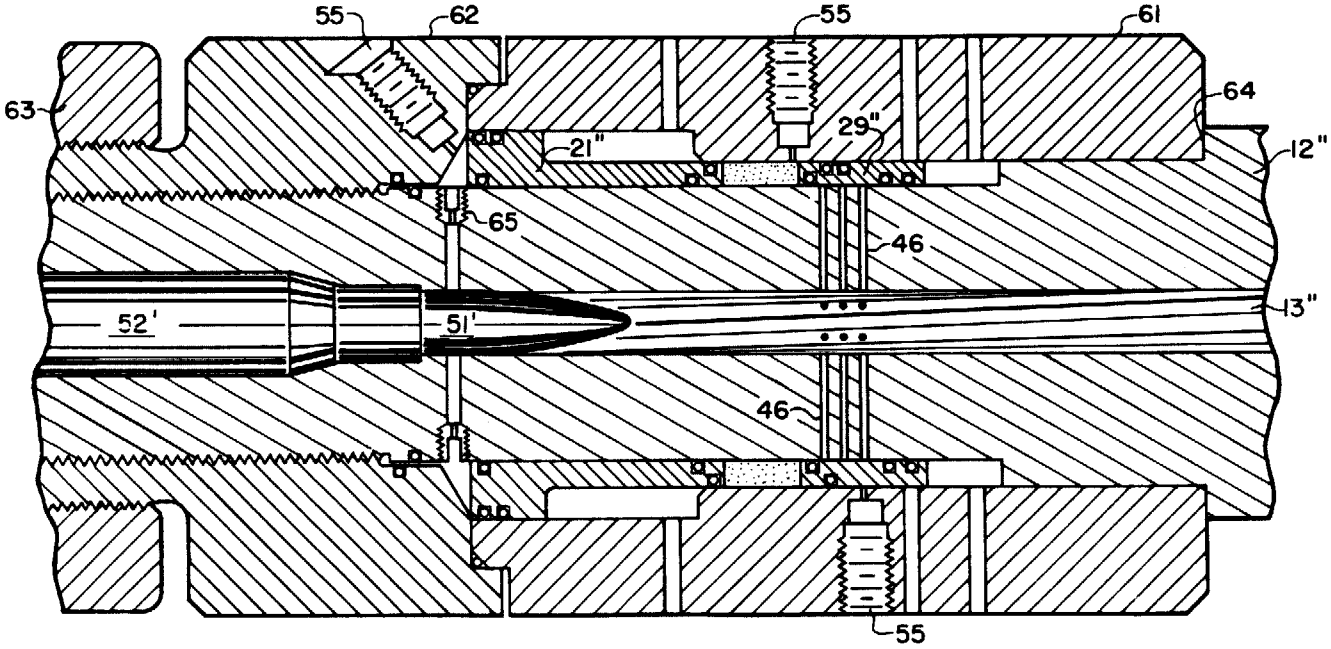
FIG. 4 illustrates a test configuration utilizing conventional 50 caliber fixed ammunition.

Referring to FIG. 4, a test configuration for the present invention is illustrated and suggests the ease at which the principles of the invention may be applied to existing solid propellant weapons. A conventional gun, in this case a 50 caliber gun has a barrel 12'' and a bore 13''. A manifold having a chamber end 62 and a forward end 61 is concentrically held onto barrel 12'' and threadably received into receiver ring 63 with barrel 12''. A shoulder 64 on barrel 12'' provides forward indexing and assembly interfittings for the system. A 50 caliber cartridge case 52' and a projectile 51' are illustrated in the chambered position. Connection to the combustion gases for operation of differential piston 21'' was controlled by means of gas jets 65 threadably received into barrel 12''. The limiting effect of jets 65 permitted change of jets to study the effect of changing the size of the gas port. Pressure transducers 55 were mounted at the gas side of differential piston 21'' within fluid reservoir between piston 21'' and check valve 29'' and in fluid communication with the uncovered conduits 46 such that the actuation pressure, reservoir pressure, and injection pressure could be effectively monitored. In such test fixtures, projectile velocities have achieved between 20 and 25 percent increases with no apparent damage to bore 13'' and the operating mechanism associated with the weapon.

The foregoing description taken together with the appended claims constitutes a disclosure such to as enable a person skilled in the ordnance and the gunsmithing arts and having the benefit of the teachings contained therein to make and use the invention. Further, the structures herein described meet the objects of invention, and generally constitute a meritorious advance in the art unobvious to such an artisan not having the benefit of these teachings.

What is claimed is:

1. A gun for utilizing liquid propellant to increase velocity of a projectile fired with a solid propellant charge comprising:

a barrel having a breech end and a muzzle end and a bore extending therethrough:

a chamber in said breech end configured to receive a cartridge therein;

port means extending through said barrel intermediate said chamber and said muzzle end for passing gas therethrough;

manifold means comprised of a plurality of sections concentrically surrounding said barrel and said plurality of sections spaced therefrom different distances for providing a liquid reservoir and positioned to enclose the port means therein;

differentially shaped piston means to cooperate with said differentially spaced manifold sections fittingly sealing said liquid reservoir and configured to transmit gas pressure from said port means to said liquid reservoir;

conduit means located in said barrel between said port means and said muzzle end and communicating with said liquid reservoir for passage of liquid therethrough, whereby movement of said piston under influence of said propellant gas pressure causes liquid injection within said bore, and a check valve concentrically held about said barrel within said manifold to selectively close said conduit means.

2. A gun according to claim 1 wherein said port means includes a plurality of radial bores extending radially outwardly from said bore.

3. A gun according to claim 1 wherein said check valve is spring biased in the position closing said conduit means.

4. A gun according to claim 3 further including an adjustable stop means cooperating with said differential piston to provide a datum position therefor, whereby the volume of said liquid reservoir may be controlled by adjusting the position of said differential piston.

5. A gun according to claim 4 in which said liquid reservoir is fed from an external source of liquid propellant.

6. A gun according to claim 5 wherein said source of liquid propellant communicates with said liquid reservoir via said check valve, whereby said external source of liquid propellant is closed when said check valve is moved to uncover said conduit means.

* * * * *